US011725481B2

(12) United States Patent
Loh et al.

(10) Patent No.: US 11,725,481 B2
(45) Date of Patent: Aug. 15, 2023

(54) WET-MATE RETRIEVABLE FILTER SYSTEM

(71) Applicant: Baker Hughes Oilfield Operations LLC, Houston, TX (US)

(72) Inventors: Yuh Loh, Cypress, TX (US); Zhi Yong He, Cypress, TX (US); Tony Rocco Hepp, Claremore, OK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/727,152

(22) Filed: Apr. 22, 2022

(65) Prior Publication Data

US 2022/0243557 A1 Aug. 4, 2022

Related U.S. Application Data

(63) Continuation of application No. 16/530,135, filed on Aug. 2, 2019, now Pat. No. 11,377,929.

(60) Provisional application No. 62/728,597, filed on Sep. 7, 2018.

(51) Int. Cl.

| | |
|---|---|
| ***E21B 34/14*** | (2006.01) |
| ***E21B 43/08*** | (2006.01) |
| ***E21B 34/10*** | (2006.01) |

(52) U.S. Cl.

CPC ..... *E21B 34/14* (2013.01); *E21B 34/10* (2013.01); *E21B 43/08* (2013.01)

(58) Field of Classification Search

CPC ..... E21B 34/10; E21B 43/08; E21B 34/14

See application file for complete search history.

(56) References Cited

U.S. PATENT DOCUMENTS

| | | | |
|---|---|---|---|
| 4,119,146 | A | 10/1978 | Taylor |
| 4,431,051 | A | 2/1984 | Adams, Jr. |
| 7,243,740 | B2 | 7/2007 | Frith |
| 7,431,082 | B2 | 10/2008 | Holt et al. |
| 7,814,969 | B2 | 10/2010 | Shaw |

(Continued)

FOREIGN PATENT DOCUMENTS

| | | | |
|---|---|---|---|
| CN | 206309344 | U | 7/2017 |
| WO | 2018088910 | A1 | 5/2018 |

OTHER PUBLICATIONS

U.S. Appl. No. 16/530,135, filed Aug. 2, 2019, Final Office Action dated Nov. 8, 2021.

(Continued)

*Primary Examiner* — Dany E Akakpo

(74) *Attorney, Agent, or Firm* — Bracewell LLP; Keith R. Derrington

(57) ABSTRACT

A mandrel in production tubing within a well has a side pocket with an inlet port for connection to an upper control line segment that extends upward alongside the production tubing. An outlet port is below the inlet port for connection to a lower control line segment extending below the pocket. A filter assembly is lowered through the production tubing into the pocket. A valve at a lower end of the pocket is movable from a closed position closing the outlet port to an open position opening the outlet port. A probe mounted to a lower end of the filter assembly engages and pushes the valve from the closed position to the open position while the filter assembly is being seated in the pocket.

8 Claims, 5 Drawing Sheets

(56) References Cited

U.S. PATENT DOCUMENTS

| | | | | |
|---|---|---|---|---|
| 8,397,811 | B2 | 3/2013 | Reid | |
| 8,985,972 | B2 | 3/2015 | Tetzlaff et al. | |
| 2004/0084186 | A1 | 5/2004 | Allison | |
| 2006/0137881 | A1 | 6/2006 | Schmidt et al. | |
| 2013/0220599 | A1* | 8/2013 | Rae | E21B 23/03 166/250.01 |
| 2014/0116681 | A1 | 5/2014 | Broussard | |
| 2015/0308239 | A1* | 10/2015 | Langlais | E21B 43/08 166/278 |
| 2020/0080398 | A1 | 3/2020 | Loh et al. | |

OTHER PUBLICATIONS

U.S. Appl. No. 16/530,135, filed Aug. 2, 2019, Non-Final Office Action dated May 6, 2021.

* cited by examiner

WET-MATE RETRIEVABLE FILTER SYSTEM

CROSS-REFERENCE TO RELATED APPLICATION

This application is a continuation of and claims priority to and the benefit of co-pending U.S. application Ser. No. 16/530,135 filed Aug. 2, 2019, which claimed priority to provisional application No. 62/728,597, filed Sep. 7, 2018; the full disclosures of which are hereby incorporated by reference herein in their entireties and for all purposes.

FIELD OF DISCLOSURE

The present disclosure relates to a control line extending into a well that has a down hole filter that may be retrieved for cleaning or replacement without retrieving the control line.

BACKGROUND

Hydrocarbon wells may have control lines extending alongside production tubing. A control line is a small-diameter tube for delivering fluids downhole for various purposes. The fluid may be a chemical for well treatment, or it may be a hydraulic fluid for actuating a downhole valve.

Debris can clog the control line and flow control devices downstream of the control line. When full of debris, the operator must pull the entire completion, including the production tubing and the control line. Retrieving the entire completion is expensive and time-consuming.

SUMMARY

An apparatus for injecting a fluid into a well comprises a pocket having a longitudinal axis and adapted to be mounted in a string of production tubing in a well. An inlet port extends into the pocket for connection to an upper control line segment that extends upward alongside the production tubing. An outlet port is below the inlet port for connection to a lower control line segment extending below the pocket. A filter assembly is adapted to be lowered and retrieved through the production tubing into the pocket. The filter assembly has a filter element for filtering fluid flowing from the inlet port to the outlet port. A valve element at a lower end of the pocket is movable relative to the pocket between a closed position closing the outlet port and an open position opening the outlet port. A probe mounted to a lower end of the filter assembly engages and pushes the valve element from the closed position to the open position while the filter assembly is being seated in the pocket.

In the embodiment shown, the valve element moves downward from the closed position to the open position.

The apparatus may include a mandrel for connection into the production tubing. The mandrel has a main bore for registering with an interior of the production tubing. The pocket is in the mandrel alongside the main bore.

The pocket has an upper end that is open to entry of well fluid from the production tubing into the pocket while the filter assembly is out of the pocket. Wet mate means prevents contact of well fluid in the pocket with control line fluid in the outlet port while the probe is pushing the valve element to the open position.

The inlet port extends laterally into the pocket below the open upper end. The filter assembly has seals that seal to the pocket above and below the inlet port once the filter assembly has landed in the pocket.

A manifold at a lower end of the pocket has a flow passage leading to the outlet port. The valve element is carried in the flow passage for movement between the closed and open positions and is biased upward toward the closed position, blocking entry of well fluid in the pocket from the flow passage in the manifold. The probe comprises an outer tube and an inner tube, the outer tube being biased downward relative to the inner tube. The inner tube is configured to push the valve element downward to open the flow passage while the filter assembly is being lowered in the pocket. The outer tube is configured to land sealingly in the flow passage before the inner tube begins pushing the valve element downward, blocking entry of well fluid in the pocket from the flow passage.

The filter assembly has an adapter for engagement by a wireline tool for lowering the filter assembly into and retrieving the filter assembly from the pocket. The filter assembly has a filter housing having a housing bore containing the filter element. The filter housing has a filter inlet communicating the housing bore with the inlet port when the filter assembly is landed within the pocket. The probe is located in the housing bore below the filter element and protrudes downward from the filter housing.

The pocket has a landing shoulder at a lower end of the pocket, the valve element being carried below the landing shoulder. The outer tube has a lower end that lands on the landing shoulder, enabling the inner tube to continue downward movement with the housing after the outer tube lands on the landing shoulder to push the valve element downward to the open position. The outer tube and the landing shoulder have seal means for sealing the outer tube to the pocket before the inner tube begins pushing the valve element downward, blocking entry of well fluid in the pocket from the valve member while the valve member is being pushed to the open position. A seal at the landing shoulder seals between the outer tube and the pocket when the outer tube lands on the landing shoulder. The inner tube has an inner passage in fluid communication with the bore. An inner tube port at a lower end of the inner passage is positioned to be below the lower end of the outer tube after the inner tube has moved the valve element to the open position for communicating control line fluid from the housing bore to the valve element.

Figure 1:
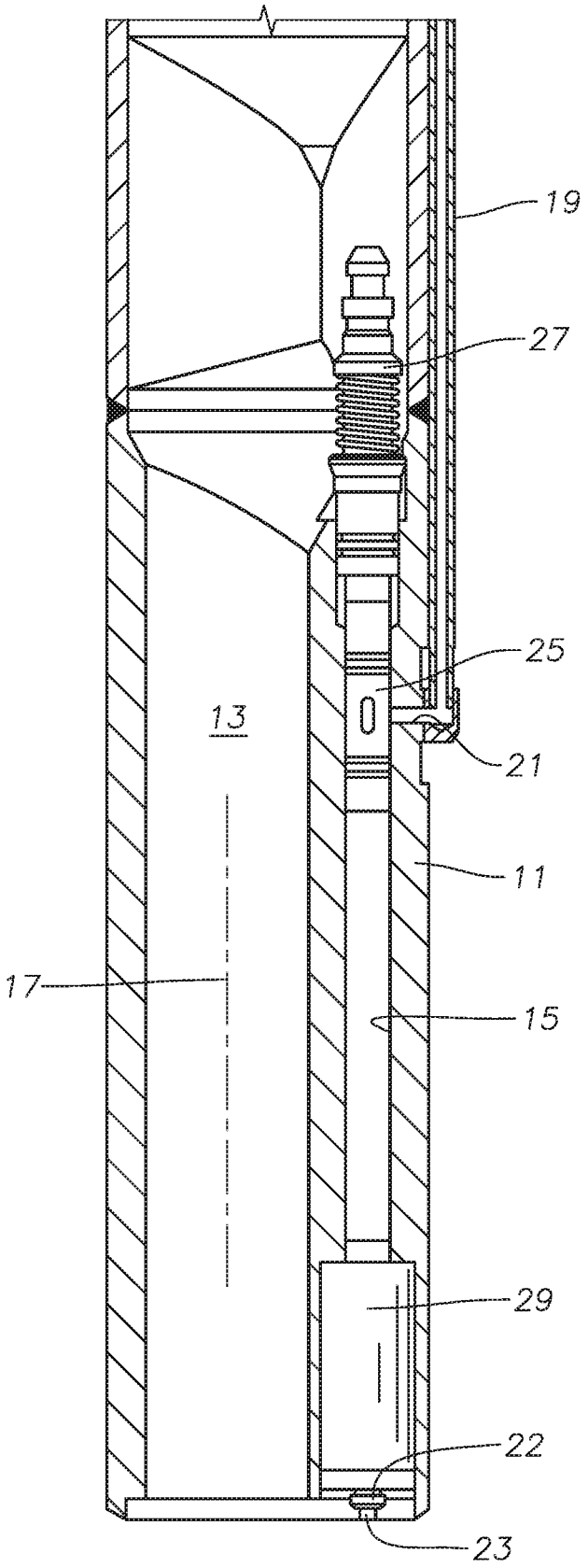
FIG. 1 is a side view of a retrievable filter assembly in accordance with this disclosure, shown installed in a side-pocket mandrel.

While the disclosure will be described in connection with the preferred embodiments, it will be understood that it is not intended to limit the disclosure to that embodiment. On the contrary, it is intended to cover all alternatives, modifications, and equivalents, as may be included within the scope of the claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a side-pocket mandrel 11 will connect into production tubing (not shown) in a well and may be thousands of feet below a wellhead (not shown) at the surface. Mandrel 11 has a main bore 13 through which well tools and equipment may be lowered. Mandrel 11 has a side pocket 15, which is a bore parallel with axis 17 of main bore 13.

An upper control line segment 19 extends down from the wellhead alongside the production tubing and connects to an upper control line segment inlet port 21 in pocket 15. Connected to a lower control line segment outlet port 22 is a lower control line segment 23 that extends downward from mandrel 11 alongside the production tubing for delivering chemicals or other fluids down hole. An operator will pump fluids down upper control line segment 19 into lower control line segment 23 for various purposes.

A retrievable filter assembly 25 will be in pocket 15 during operation for filtering the fluids pumped down upper control line segment 19. Filter assembly 25 can be retrieved from pocket 15 and brought up the production tubing to the wellhead for cleaning or replacement. A conventional adapter 27 on the upper end of filter assembly 25 enables a wire line tool to be lowered down the production tubing into main bore 13 for running and retrieving filter assembly 25.

Filter assembly 25 is lowered into pocket 15 and engages a manifold 29 mounted to mandrel 11 below pocket 15. Manifold 29 delivers fluid passing through filter assembly 25 from upper control line segment 19 to lower control line segment 23 while filter assembly 25 is in pocket 15. Manifold 29 is not retrievable and also blocks well fluid from entering lower control line segment 23 while filter assembly 25 is removed from pocket 15.

Figure 2:
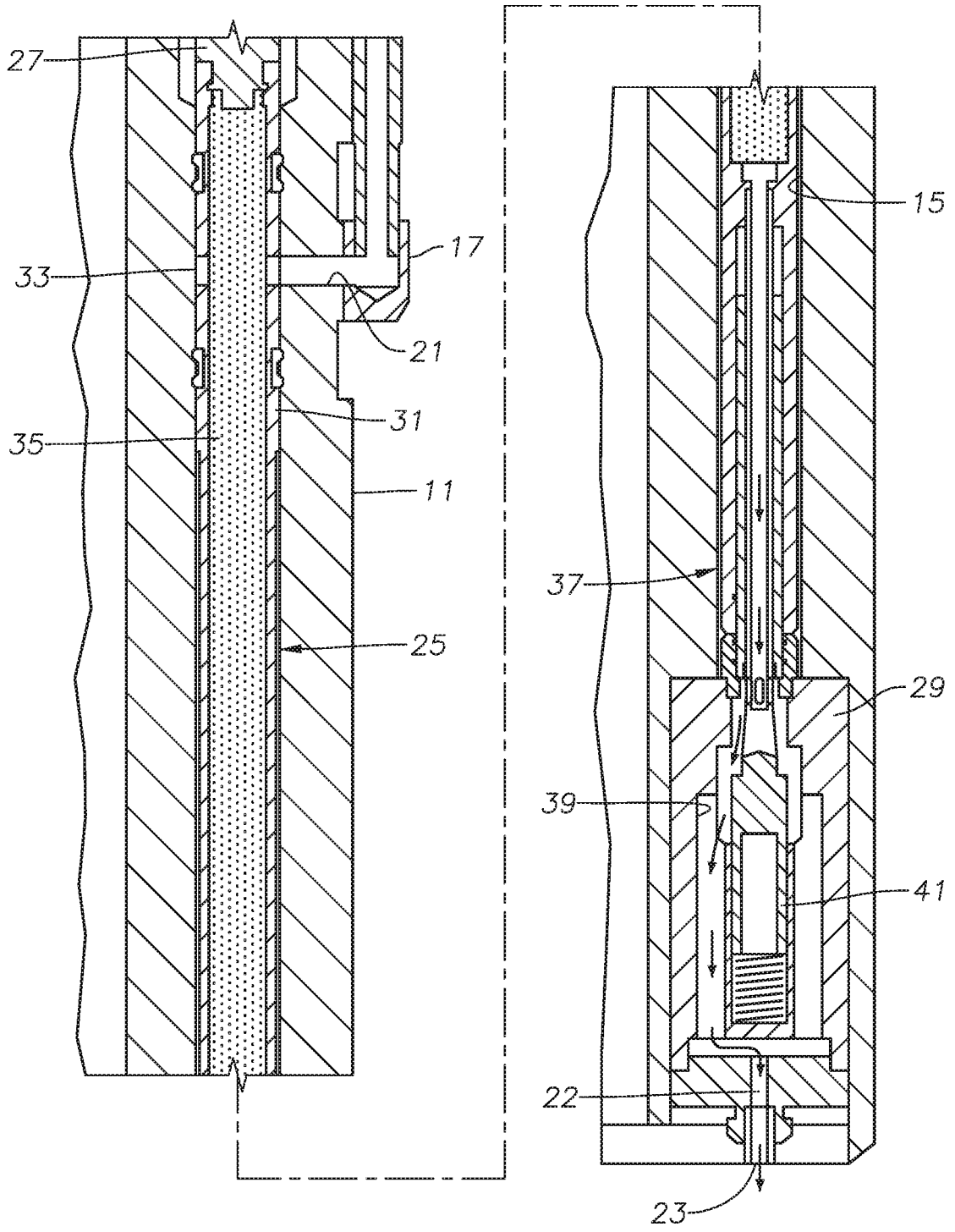
FIG. 2 is an enlarged, cropped sectional view of FIG. 1, showing a retrievable filter, mandrel pocket, control line-mandrel connection point, and manifold.

Referring to FIG. 2, filter assembly 25 has a tubular filter housing 31. When filter assembly 25 lands in pocket 15, a filter inlet port 33 in a side wall of filter housing 31 will register with mandrel inlet port 21 to communicate fluid in upper control line segment 19 into the interior of filter housing 31. At least one filter element 35 is located within the interior of filter housing 31. In this example, there are two concentric cylindrical filter elements 35, one located within the other. A probe assembly 37 on the lower end of filter element 25 will enter flow passages 39 in manifold 29 and actuate a valve element 41 in manifold 29. When moved by probe 37 from an upper closed position to a lower open position, which is shown in FIG. 2, valve element 41 enables fluid in the interior of filter housing 31 to flow into lower control line segment 23.

Figure 3:
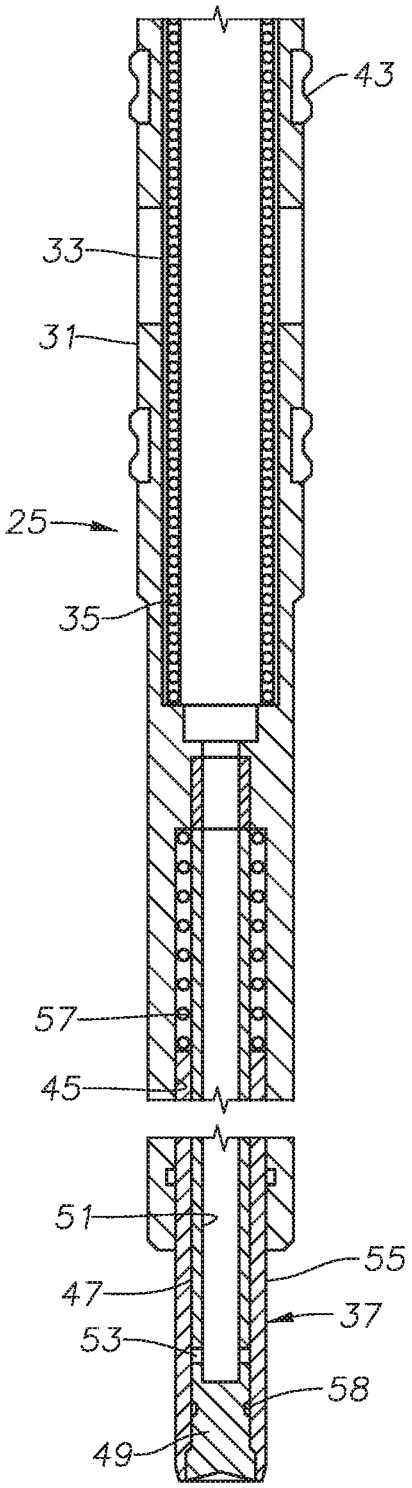
FIG. 3 is a further enlarged sectional view of a retrievable filter only, illustrating the retrievable filter outside the mandrel and in a closed position.

Referring to FIG. 3, filter housing 31 has annular exterior seals 43 for sealing to pocket 15 (FIG. 2) above upper control line segment inlet port 21 (FIG. 2). The interior of filter housing 31 comprises a bore 45 that has an upper portion containing filter elements 35. Adapter 27 (FIG. 1) closes the upper end of filter housing bore 45. Filter housing inlet ports 33 lead to filter housing bore 45.

In this embodiment, probe assembly 37 includes an inner tube 47 that is fixed in a lower portion of filter housing bore 45. Inner tube 47 has an inner tube bore 51 that is open at its upper end to filter housing bore 45 and has a closed lower end 49. Closed lower end 49 protrudes below filter housing 31. Inner tube 47 has outlet ports 53 in its side wall near closed lower end 49 that lead from inner tube bore 51 to the exterior.

Figure 4:
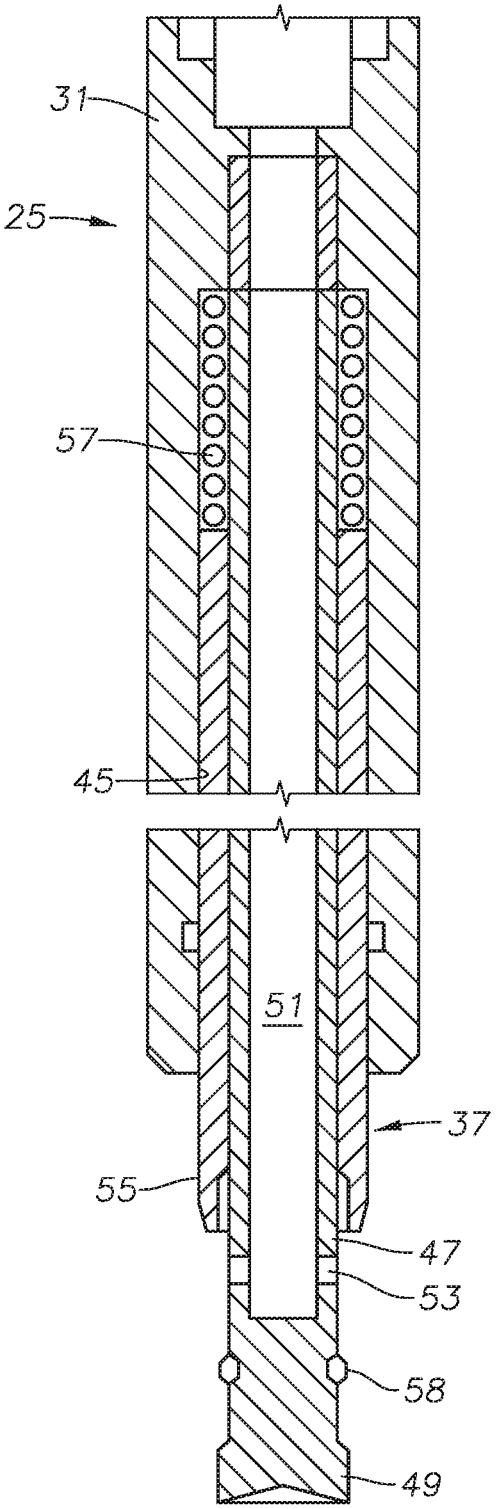
FIG. 4 is a partial, further enlarged sectional view of the retrievable filter of FIG. 3 shown in an open position.

An outer tube 55 closely receives inner tube 47 and is axially movable relative to inner tube 47. In its lower or extended position, the lower end of outer tube 55 is flush with the lower end of inner tube 47, as shown in FIG. 3. In this lower position, outer tube 55 blocks inner tube outlet ports 53. When outer tube 55 is in its upper retracted position, inner tube outlet ports 53 will be open, as shown in FIG. 4, because the lower end of outer tube 55 will be above them. A coil spring 57 in filter housing bore 45 above outer tube 55 urges outer tube 55 to its lower position. An inner tube seal 58 below inner tube outlet ports 53 will seal to the bore of outer tube 55 while outer tube 55 is in the lower extended position.

Figure 5:
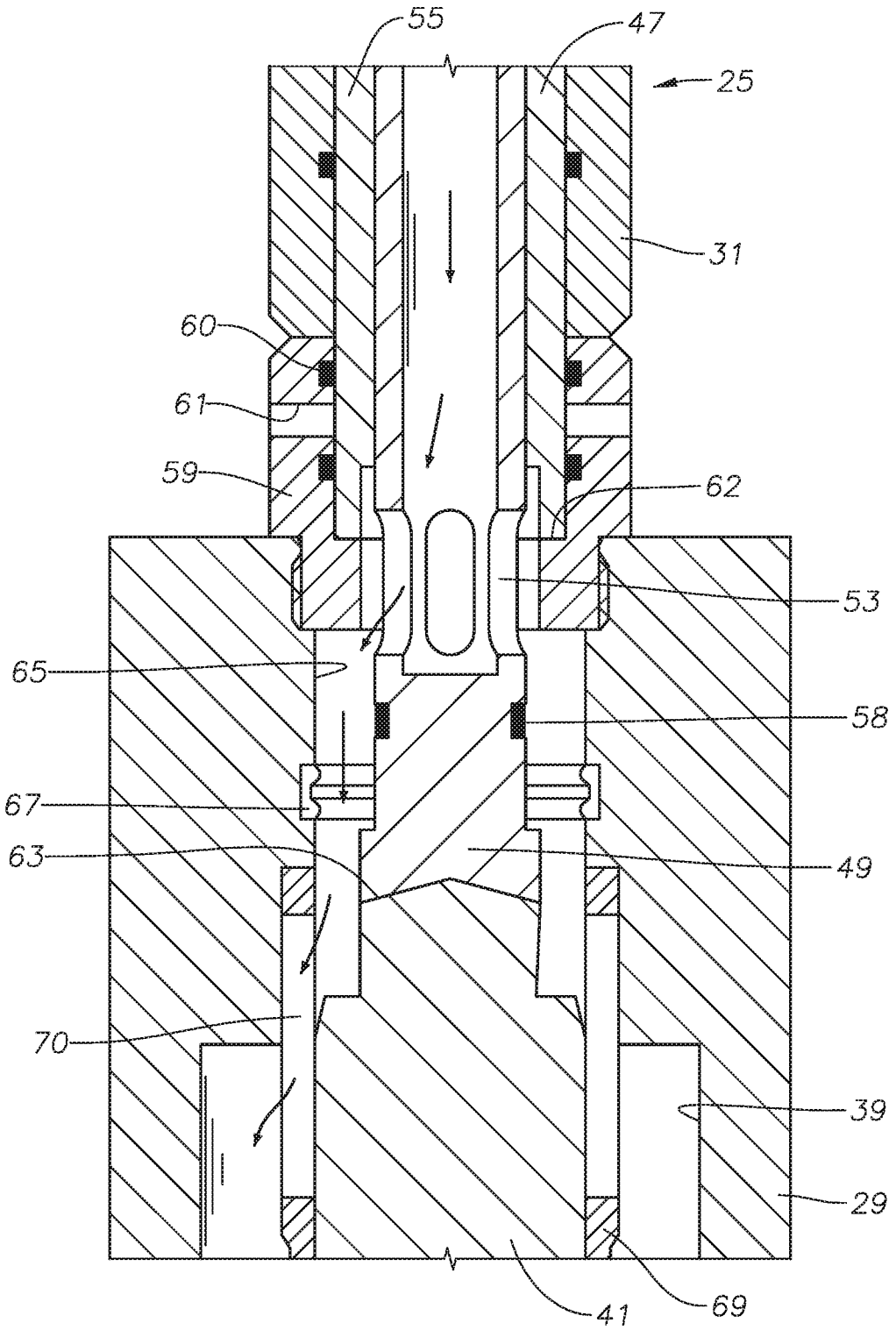
FIG. 5 is a sectional view of the retrievable filter of FIG. 3, stabbed into the mandrel pocket of FIG. 2, opening a valve in the manifold.

Referring to FIG. 5, manifold 29 has a receptacle 59 on its upper end with manifold or landing shoulder seals 60 for sealing to the outer diameter of outer tube 55 as filter assembly 25 lands in pocket 15 (FIG. 2). Also, the lower end of outer tube 55 will land on an upward-facing receptacle shoulder 62 in receptacle 59 below manifold seals 60 as filter assembly 25 lands in pocket 15. In this example, receptacle 59 secures by threads to the upper end of manifold 29, but other arrangements are feasible. Drain ports 61 lead laterally from the bore of receptacle 59 from a point between seals 60 for expelling well fluid from receptacle 59 as inner and outer tubes 47, 55 stab into receptacle 59.

Valve element 41 has a neck 63 on its upper end that has a diameter smaller than the lower portion of valve element 41 and sized to enter receptacle 59. The lower portion of valve element 41 is closely received with an upper portion of a manifold bore 65 and sealed by a seal 67 when valve element 41 is in its upper position. Valve element neck 63 has a seal 64 that seals to the bore of receptacle 59 below upward facing shoulder 62 when valve element 41 is in its upper position.

In this example, valve element 41 moves axially within a liner 69 fixed within manifold bore 65. Manifold bore 65 has a larger diameter than the outer diameter of liner 69. Liner 69 has ports 70 in its side wall that lead to manifold bore 69, which is part of the flow passages 39 in manifold 29. Valve element 41 blocks liner ports 70 while in the upper position.

During running of filter assembly 25 into the well, preferably filter inlet ports 33 will be sealed or closed to prevent well fluid entering filter housing bore 45 before filter assembly 25 stabs into mating engagement with manifold 29. This temporary sealing could be accomplished several ways. For example, technicians could plug filter inlet ports 33 with a dissolving material that seals filter inlet ports 33 for a time long enough to run filter assembly 25 and stab it into manifold 29. The dissolving material then dissolves, allowing control fluid from upper control line segment 19 to flow into filter housing bore 45. Alternately, technicians could wrap filter housing 31 at filter inlet ports 33 with a dissolving tape. Another alternate would be to wrap filter housing 31 at filter inlet ports 33 with a non-dissolving tape. After filter assembly 25 has sealingly stabbed into manifold, technicians can apply fluid pressure from upper control line segment 19 at a level sufficient to cause the tape to rupture.

Figure 6:
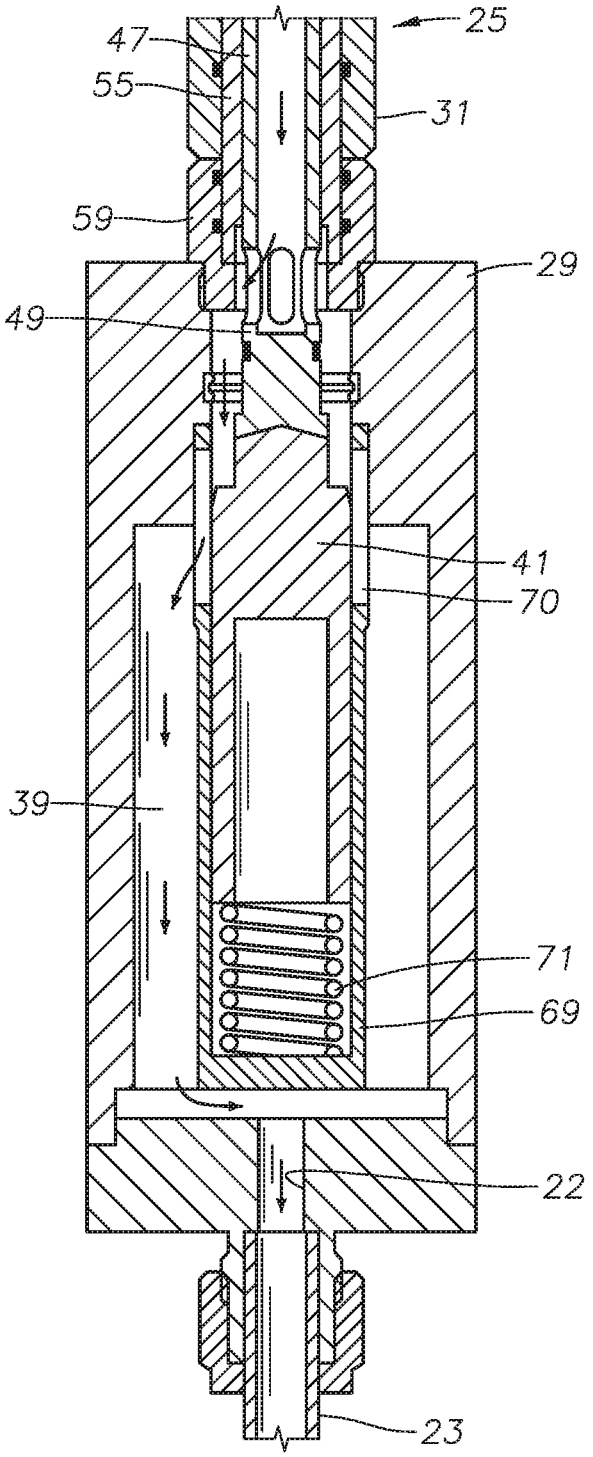
FIG. 6 is a sectional view showing remaining portions of the manifold of FIG. 5.

When outer tube 55 and inner tube 47 stab into receptacle 59, further downward force on filter assembly housing 31 will cause outer tube 55 to retract and will cause closed lower end 49 to push valve element 41 downward to the open position shown in FIGS. 5 and 6. Control fluid may then flow through filter assembly housing 31, inner tube 47, liner ports 70 and around valve element 41 through manifold flow passages 39 into lower control line segment 23.

Figure 7:
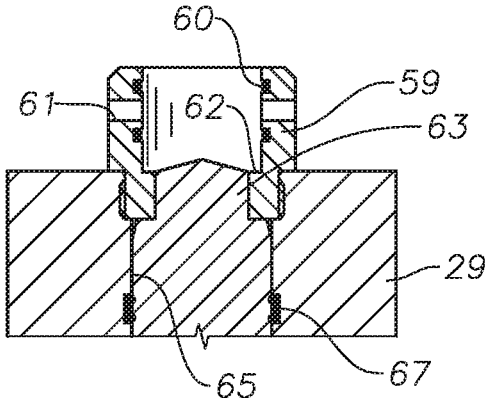
FIG. 7 is a sectional view showing the valve of the manifold of FIG. 5 closed.

Referring to FIG. 6, a coil spring 71 locates between a closed lower end of liner 69 and the lower end of valve element 41. Coil spring 71 urges valve element 41 upward toward the closed position. When filter assembly 31 has been removed from pocket 15 (FIG. 1), coil spring 71 will place valve element 41 in the closed upper position shown in FIG. 7.

While filter assembly 31 is removed from pocket 15, well fluid in mandrel main bore 13 will also be present in pocket 15 and within receptacle 59. The closed position of valve element 41 seals well fluid within receptacle 59 from manifold flow passages 39 and lower control line segment 23 (FIG. 6). The wet-mate arrangement of inner and outer tubes 47, 55, receptacle 59 and valve element 41 prevents well fluid from entering manifold flow passages 39 while valve element 41 is moving from the closed to the open position.

The present disclosure described herein, therefore, is well adapted to carry out the objects and attain the ends and advantages mentioned, as well as others inherent therein. While only one embodiment of the disclosure has been given for purposes of disclosure, numerous changes exist in the details of procedures for accomplishing the desired results. These and other similar modifications will readily suggest themselves to those skilled in the art, and are intended to be encompassed within the scope of the appended claims.

The invention claimed is:

1. An apparatus for connecting in a well an upper control line segment to a lower control line segment, comprising:

a manifold adapted to be secured downhole in the well, the manifold having a manifold flow passage with a manifold outlet port leading to the lower control line segment;

a housing adapted to be lowered into the well into engagement with the manifold, the housing having a housing bore in fluid communication with the upper control line segment;

an outer tube carried within the housing bore, the outer tube having a lower end that extends below the housing and lands in sealing engagement with the manifold, and the outer tube having an extended position blocking communication between the housing bore and manifold while the housing is being lowered into the well;

an inner tube carried within the outer tube;

the outer tube being retractable relative to the housing in response to continued downward movement of the housing after the lower end of the outer tube lands so that the housing bore is in communication with the manifold.

2. The apparatus according to claim 1, further comprising an outer tube spring that urges the outer tube toward the extended position.

3. The apparatus according to claim 1, further comprising a manifold receptacle at an upper end of the manifold flow passage, the manifold receptacle having a landing shoulder.

4. The apparatus according to claim 3, further comprising:

a valve element carried within the manifold between an upper closed position closing communication of the manifold receptacle with the manifold flow passage and a lower open position, opening communication of the manifold receptacle with the manifold flow passage;

a valve element spring that urges the valve element toward the upper closed position; and wherein the valve element has an upper end that is engaged by the closed lower end of the inner tube after the outer tube lands in the receptacle, the valve element being pushed downward to the open position by continued downward movement of the housing.

5. The apparatus according to claim 3, further comprising a pocket extending upward from the receptacle, the pocket having:

an open upper end into which the housing enters, and an upper control line segment port for fluid communication with the upper control line segment; and wherein the housing has a housing inlet port that registers with the upper control line segment port when the lower end of the outer tube is landed in the manifold receptacle disposed at the upper end of the manifold flow passage.

6. The apparatus according to claim 1, further comprising a filter in the housing bore.

7. The apparatus according to claim 1, further comprising:

a pocket extending upward from a receptacle, the pocket having an open upper end into which the housing enters, the pocket having an upper control line segment port for fluid communication with the upper control line segment; wherein the housing has a closed upper end that seals the open upper end of the pocket when the outer tube lands in the receptacle; and the housing has a housing inlet port that registers with the upper control line segment port when the lower end of the outer tube has landed in the receptacle.

8. The apparatus according to claim 1, wherein the inner tube is rigidly mounted to the housing, the inner tube having a closed lower end and an inner tube outlet port above the closed lower end, the inner tube having an upper end in fluid communication with the housing bore.

* * * * *